US005709988A

United States Patent [19]

Black et al.

[11] Patent Number: 5,709,988

[45] Date of Patent: Jan. 20, 1998

[54] TABULAR GRAIN EMULSIONS EXHIBITING RELATIVELY CONSTANT HIGH SENSITIVITIES

[75] Inventors: Donald Lee Black, Webster; Roger Anthony Bryant; Mark Edward Irving, both of Rochester, all of N.Y.

[73] Assignee: Eastman Kodak Company, Rochester, N.Y.

[21] Appl. No.: 399,798

[22] Filed: Mar. 7, 1995

[51] Int. Cl.[6] ..... G03C 1/005; G03C 1/035

[52] U.S. Cl. ..... 430/567; 430/569

[58] Field of Search ..... 430/567, 569

[56] References Cited

U.S. PATENT DOCUMENTS

| | | | |
|---|---|---|---|
| 4,399,215 | 8/1983 | Wey | 430/567 |
| 4,400,463 | 8/1983 | Maskasky | 430/434 |
| 4,433,048 | 2/1984 | Solberg et al. | 430/434 |
| 4,434,226 | 2/1984 | Wilgus et al. | 430/567 |
| 4,435,501 | 3/1984 | Maskasky | 430/434 |
| 4,439,520 | 3/1984 | Kofron et al. | 430/434 |
| 4,806,461 | 2/1989 | Ikeda et al. | 430/567 |
| 5,061,616 | 10/1991 | Piggin et al. | 430/569 |
| 5,418,124 | 5/1995 | Suga et al. | 430/567 |
| 5,498,516 | 3/1996 | Kikuchi et al. | 430/567 |

FOREIGN PATENT DOCUMENTS

| | | | |
|---|---|---|---|
| 0 431 585 | 6/1991 | European Pat. Off. | G03C 1/035 |
| 140737 | 5/1992 | Japan | G03C 1/035 |
| 149541 | 5/1992 | Japan | G03C 1/015 |
| 182635 | 6/1992 | Japan | G03C 1/015 |

*Primary Examiner*—Mark F. Huff
*Attorney, Agent, or Firm*—Carl O. Thomas

[57] ABSTRACT

Radiation-sensitive emulsions are disclosed comprised of high bromide tabular grains containing a peripheral band of increased iodide concentration. The tabular grains exhibit an average equivalent circular diameter of at least 2.0 μm and are of a face centered cubic crystal lattice structure of the rock salt type. The tabular grains include central and peripheral regions extending between their major faces. The peripheral region is up to 0.2 μm in width and contains an iodide concentration at least 2 mole percent higher than that of the central region measured at a location adjacent the peripheral region. Dislocations are present in the peripheral region to increase sensitivity and are minimized in the central region to maintain relatively constant sensitivities when pressure is applied locally.

7 Claims, No Drawings

TABULAR GRAIN EMULSIONS EXHIBITING RELATIVELY CONSTANT HIGH SENSITIVITIES

FIELD OF THE INVENTION

The invention relates to silver halide photographic emulsions.

DEFINITIONS

A tabular grain emulsion is one in which at least 50 percent of total grain projected area is accounted for by tabular grains.

As employed herein the term "tabular grain" is employed to indicate grains that have two parallel major faces substantially larger than any remaining face and that exhibit an aspect ratio of at least 2.

Aspect ratio is the ratio of tabular grain equivalent circular diameter (ECD) divided by thickness (t). The average aspect ratio of a tabular grain emulsion is the ratio of average grain ECD divided by average grain thickness.

The coefficient of variation (COV) of grain size of an emulsion is 100 times the standard deviation ($\sigma$) of grain size divided by mean ECD.

In referring to grains and emulsions containing two or more halides, the halides are named in order of ascending concentrations.

The term "dislocation" refers to a crystal lattice defect that can be observed by microscopic examination of a tabular grain major face.

BACKGROUND

Marked improvements in the performance of photographic emulsions began in the 1980's, resulting from the introduction of tabular grain emulsions into photographic products. A wide range of photographic advantages have been provided by tabular grain emulsions, such as improved speed-granularity relationships, increased covering power (both on an absolute basis and as a function of binder hardening), more rapid developability, increased thermal stability, increased separation of native and spectral sensitization imparted imaging speeds, and improved image sharpness in both mono- and multi-emulsion layer formats.

Although tabular grain emulsions can be selected to provide a variety of performance advantages, depending upon the photographic application to be served, by far the most intense efforts have been invested in achieving emulsions of the highest attainable photographic speeds with minimal attendant granularity. The tabular grain emulsions that satisfy this objective exhibit an average ECD of at least 2.0 μm. The tabular grains exhibit a face centered cubic crystal lattice structure of the rock salt type. The tabular grains are of a high (>50 mole %) bromide composition and contain a minor amount of iodide. Typically the emulsions are silver iodobromide tabular grain emulsions. Wilgus et al U.S. Pat. No. 4,434,226 and Kofron et al U.S. Pat. No. 4,439,520 disclose silver iodobromide tabular grain emulsions. Solberg et al U.S. Pat. No. 4,433,048 demonstrates that in preparing silver iodobromide tabular grain emulsions an additional speed increase without a corresponding increase in granularity can be obtained by increasing the iodide concentration in a peripheral region of the tabular grain laterally displaced from a central region.

Sometime after silver iodobromide tabular grain emulsions appeared in photographic film products Ikeda et al U.S. Pat. No. 4,806,461 microscopically examined silver iodobromide tabular grains and concluded their superior speed-granularity performance could be attributed in part to the presence of 10 or more dislocations in tabular grains accounting for at least 50 percent of total grain projected area.

Thereafter, a number of attempts to increase the number of dislocations in tabular grains have been reported, as illustrated by Maruyama et al EPO (published patent application) 0 431 585 (priority Dec. 5, 1989; Suga et al Japanese Kokai (published patent application) 140,737; Maruyama Japanese Kokai 149,541 [1992] filed Oct. 15, 1990; and Suga et al Japanese Kokai 182,635 [1992] filed Nov. 19, 1990, hereinafter collectively referred to as the Maruyama-Suga investigations. Two alternative techniques are disclosed for introducing dislocations: (1) a high iodide phase is epitaxially grown at the edges and/or corners of the tabular grains or (2) iodide displacement of a more soluble halide (i.e., halide conversion) is undertaken at the edges corners and/or edges of the tabular grains. Although these techniques increase the number of dislocations in the grains taken as a whole, they are highly disadvantageous. Dealing with (1) first, the epitaxial deposition of a high (>90 mole %) iodide phase at the edges of the tabular grains places very high iodide concentrations in the region of latent image formation and is a major obstacle to emulsion development. Maskasky U.S. Pat. No. 4,435,501 was the first to teach the selective deposition of silver salt epitaxy onto the corners and/or edges of tabular grains; however, Maskasky demonstrated higher photographic speeds to result from the epitaxial deposition of a higher solubility halide (specifically, chloride) in preference to a lower solubility halide (e.g., high iodide). Maskasky also demonstrated that the silver salt epitaxy in none of its various compositions was tabular in character. Turning to (2), it is also well recognized that halide conversion of tabular grains degrades or destroys the tabular character of the grains. Warnings against halide conversion in preparing tabular grain emulsions are provided by Wey U.S. Pat. No. 4,399,215 and Maskasky U.S. Pat. No. 4,400,463. While technique (2) appears to have avoided destroying the tabular grains in their entirety by limiting the extent of halide conversion, to the extent that halide conversion occurs it is detrimental to maintaining the grain in its entirety in a tabular form.

Problem to be Solved

Although tabular grain emulsions have improved photographic performance in many ways, the large (≧2.0 μm) ECD's of high speed tabular grain emulsions have rendered them susceptible to performance degradation by the local application of pressure to emulsion coatings. Large mean ECD silver iodobromide tabular grain emulsions exhibit pressure desensitization when subjected to locally applied pressure of the type that can be experienced by film kinking, the film being dragged across a surface or protrusion in use, or excessive guide roller contact pressure.

The Maruyama-Suga investigations noted above report reductions in pressure sensitivity, but with the penalties to tabular grain integrity and performance noted above.

Piggin et al U.S. Pat. No. 5,061,616 was the first to report obtaining increased constancy of sensitivity as a function of applied pressure while still obtaining the superior sensitivity levels demonstrated by silver iodobromide tabular grain emulsions with non-uniform iodide distribution. The important advantage of Piggin et al over the Maruyama-Suga investigations is that the grains were entirely tabular without high (>90 mole %) iodide regions that could arrest development or any halide conversion that could degrade the tabular character of the grains.

The specific approach which Piggin et al teaches is as follows:

(a) The pAg of the emulsion dispersing medium is adjusted to a region that is quite different from that taught by Wilgus et al, Kofron et al and Solberg et al. In this region the corners of the tabular grains become rounded by grain ripening.

(b) AgI is next precipitated at the tabular grain corners so that the rounded corners are grown back to their original conformation.

(c) While remaining within the pAg boundaries of (a), AgIBr is grown over the major faces of the tabular grains to create higher iodide laminae on the original major faces of the tabular grains. The primary source of iodide in growing the major face laminae is the corner AgI. This results in elimination of the silver iodide edge deposits as formation of the laminae is completed.

(d) Optionally, but preferably, a final AgBr shelling step is performed.

The clear disadvantage of the Piggin et al approach is that at least one and preferably two distinct growths occur on the major faces of the tabular grains, thereby decreasing their average aspect ratio. Piggin et al reports mean tabular grain thicknesses of 0.13 μm, which is well in excess of the <0.1 μm thicknesses presently preferred for thin tabular grain emulsions. Further, the Piggin et al approach is entirely incompatible with obtaining ultrathin (<0.07 μm) tabular grain emulsions.

SUMMARY OF THE INVENTION

The present invention has come into being as a result of systematically studying silver iodobromide tabular grain emulsions containing a higher iodide peripheral band imparting the highest observed speeds with minimal corresponding granularity. Since the highest photographic speeds are obtained with average grain ECD's of at least 2.0 μm, investigations have therefore been directed to these emulsions and correction of the problem of desensitization by locally applied pressure that results from their large mean grain sizes. By correlating microscopic observations of the tabular grains with their sensitivity and their variance in sensitivity in response to locally applied pressure, it was discovered that the percentage of grains containing dislocations anywhere in the major faces correlates with emulsion sensitivity while the percentage of grains containing dislocations in the central region of the tabular grains (that is, dislocations observed in the portions of the {111} major faces of the grains other than the peripheral band) correlates with emulsion sensitivity variance as a function of locally applied pressure. These observations led to the objective of producing novel silver iodobromide tabular grain structures that reduce the occurrence of tabular grains with 10 or more central region dislocations in relation to the incidence of tabular grains with 10 or more peripheral dislocations. Further experimentation with emulsion precipitation techniques were required before the objective was realized.

In addition to high levels of photographic sensitivity and improved constancy of sensitivity, less influenced by the local application of pressure to emulsion coatings, the novel emulsions of this invention have realized this combination of desirable properties while avoiding the degradation of grain structure encountered by other proposed solutions to the "pressure sensitivity" problem. Specifically, the emulsions of the present invention require no grains or grain regions incompatible with a tabular grain configuration. No crystal lattice structure other than the face centered cubic crystal lattice structure of the rock salt type that promotes tabular grain formation is required. Additionally, no region of the tabular grains (and, particularly, no latent image forming site within the grains) contain high (>90 mole %) iodide regions—e.g., β or γ phase silver iodide regions. Additionally, the tabular grains of the emulsions of the invention do not employ for iodide placement halide conversion, with its inherent degradation of tabular grain structure, to realize the advantages of the invention.

In one aspect this invention is directed to a radiation-sensitive emulsion in which greater than 50 percent of total grain projected is accounted for by tabular grains (i) containing greater than 50 mole percent bromide, based on silver, (ii) having parallel {111} major faces bounded by peripheral edge surfaces and (iii) containing 10 or more dislocations, wherein the tabular grains exhibit an average equivalent circular diameter of at least 2.0 μm and are each comprised of a central region and a peripheral region, each of a face centered cubic rock salt crystal lattice structure, extending between the major faces, the peripheral region separating at least a portion of the central region from the peripheral edge surfaces by up to 0.2 μm and containing an iodide concentration at least 2 mole percent based on silver higher than the iodide concentration of the central region measured within 50 nm of the peripheral region, and the dislocations in the central regions are relatively decreased in relation to the dislocations in the peripheral regions to satisfy collectively the relationship $$(P+F)\times ECD>5.0$$

where

P represents the percentage of the tabular grains containing at least 10 dislocations in the peripheral regions of the tabular grains, F represents the percentage of the tabular grains containing at least 10 dislocations in the central regions of the tabular grains, and ECD is the average equivalent circular diameter of the tabular grains in micrometers.

DESCRIPTION OF PREFERRED EMBODIMENTS

The emulsions of the invention can be viewed as improvements of the emulsions of Solberg et al, cited above and here incorporated by reference. In the emulsions of the invention greater than 50 (preferably >70 and optimally >90) percent of total grain projected area is accounted for by tabular grains having parallel {111} major faces bounded by peripheral edge surfaces. The average ECD of the tabular grains is at least 2.0 μm and can range up to the maximum average ECD compatible with photographic utility, generally identified as 10 μm. However, for most higher speed photographic applications, the tabular grains exhibit an average ECD in the range of from 2.0 to 5.0 μm.

Since the susceptibility of conventional large mean ECD tabular grain emulsions to locally applied pressure alteration of sensitivity is at least in part a function of grain size, independent of their average aspect ratios, it is recognized that the improvement of the invention is generally applicable to large ECD tabular grain emulsions. However, it is also recognized that other photographic performance characteristics are generally improved by increasing the average aspect ratio of the tabular grains. Therefore, it is preferred that the tabular grain emulsions of the emulsion have at least an intermediate (>5) and most preferably a high (>8) average aspect ratio. The tabular grain emulsions of the invention can have average aspect ratios as high as any previously reported for tabular grain emulsions of like overall halide content.

The tabular grains can have any average thickness compatible with their selected ECD and average aspect ratio. Preferred tabular grain emulsions according to the invention are those having average tabular grain thicknesses of less than 0.3 μm, most preferably less than 0.2 μm. The techniques employed for preparing the tabular grain emulsions according to the invention are compatible with preparing tabular grains of less than 0.1 μm and can be applied to the preparation of ultrathin tabular grain emulsions those having average thicknesses of less than 0.07 μm. Since at least some redistribution of silver halide onto the major faces of the tabular grains occurs during grain growth, it is contemplated that the tabular grain emulsions will generally have an average tabular grain thickness of at least 0.04 μm.

Like the tabular grains of Solberg et al, the tabular grains accounting for at least 50 percent of total grain projected area in the emulsions of the invention consist of a face centered cubic rock salt crystal lattice structure extending between the {111} major faces and laterally bounded by the peripheral edges of the tabular grains. Like Solberg et al, the tabular grains are formed with a central region extending between the {111} major faces and a laterally offset peripheral region also extending between the {111} major faces.

The tabular grains are high (>50 mole %) bromide grains, preferably containing greater than 70 mole % bromide, with chloride, if any, preferably being limited to 10 mole % or less.

The tabular grains of the invention are prepared by first providing a tabular grain emulsion of a structure compatible with the requirements of the central regions. That is, the tabular grains in the starting emulsion approximate final tabular grain ECD, projected area, thickness and average aspect ratio aims, subject to tabular grain ECD, projected area and thickness increases and average aspect ratio reductions occurring during completion of the tabular grain growth. In most instances all of these stated parameters of the central region are within the ranges described above for the completed tabular grains.

The size dispersity of the tabular grains in the starting emulsion also determines the dispersity of the tabular grain emulsions of the invention. Preferably the grain size coefficient of variations (COV) of the starting tabular grain and completed emulsions of the invention are less than 30 percent.

The starting tabular grains can correspond in halide composition to those described above for the completed tabular grains, except that the starting tabular grains need not contain iodide, since the only required iodide is that precipitated in forming the peripheral regions of the grains. It is anticipated that during emulsion preparation at least low levels of iodide will be spread over the portions of the major faces of the completed grains forming the central region. Hence, the central region is in all instances of a high bromide composition containing at least some iodide, whereas the starting tabular grains, while also of a high bromide composition, can be chosen from among silver bromide, silver chlorobromide, silver iodobromide, silver iodochlorobromide and silver chloroiodobromide compositions. The concentration of iodide in the central grain regions is preferably 15 mole percent or less, and the concentration of iodide in the starting tabular grains is, when satisfying this preference, at least slightly less, preferably 12 mole percent or less.

Subject to the requirements stated above any convenient conventional technique can be employed for providing the starting tabular grain emulsion. Since the number of dislocations in the central regions of the tabular grains of the emulsions of the invention are preferably held to a minimum, the starting tabular grains preferably contain 10 or more dislocations in less than 10 percent of the grains and, ideally, less than 1 percent of the tabular grains contain 10 or more dislocations. To accomplish this, starting tabular grain emulsions are preferably selected that contain relatively uniform halide ion concentrations. It is conventional practice to initiate silver iodobromide tabular grain precipitation by undertaking silver bromide nucleation (consuming less than 5 percent of total silver) followed immediately by iodide addition through the remainder of grain growth. These grains are satisfactory starting tabular grains for the practice of the invention.

The uniform halide composition tabular grain precipitations disclosed in the following citations illustrate the preparation of high bromide {111} tabular grain emulsions useful as starting emulsions in the practice of the invention. In those instances in which the halide composition is disclosed to be varied after a tabular grain satisfying the starting tabular grain requirements has been formed, only the initial portion of the precipitation disclosure is, of course, applicable.

(STGE-1) Abbott et al U.S. Pat. No. 4,425,425;
(STGE-2) Abbott et al U.S. Pat. No. 4,425,426;
(STGE-3) Wilgus et al U.S. Pat. No. 4,434,226;
(STGE-4) Maskasky U.S. Pat. No. 4,435,501;
(STGE-5) Kofron et al U.S. Pat. No. 4,439,520;
(STGE-6) Yamada et al U.S. Pat. No. 4,678,745;
(STGE-7) Yagi et al U.S. Pat. No. 4,686,176;
(STGE-8) Daubendiek et al U.S. Pat. No. 4,693,964;
(STGE-9) Maskasky U.S. Pat. No. 4,713,320;
(STGE-10) Nottorf U.S. Pat. No. 4,722,886;
(STGE-11) Sugimoto U.S. Pat. No. 4,755,456;
(STGE-12) Goda U.S. Pat. No. 4,775,617;
(STGE-13) Saitou et al U.S. Pat. No. 4,797,354;
(STGE-14) Ellis U.S. Pat. No. 4,801,522;
(STGE-15) Makino et al U.S. Pat. No. 4,835,322;
(STGE-16) Daubendiek et al U.S. Pat. No. 4,914,014;
(STGE-17) Saitou et al U.S. Pat. No. 4,977,074;
(STGE-18) Ikeda et al U.S. Pat. No. 4,985,350;
(STGE-19) Tsaur et al U.S. Pat. No. 5,147,771;
(STGE-20) Tsaur et al U.S. Pat. No. 5,147,772;
(STGE-21) Tsaur et al U.S. Pat. No. 5,147,773;
(STGE-22) Tsaur et al U.S. Pat. No. 5,171,659;
(STGE-23) Tsaur et al U.S. Pat. No. 5,210,013;
(STGE-24) Antoniades et al U.S. Pat. No. 5,250,403;
(STGE-25) Kim et al U.S. Pat. No. 5,272,048;
(STGE-26) Sutton et al U.S. Pat. No. 5,334,469;
(STGE-27) Black et al U.S. Pat. No. 5,334,495;
(STGE-28) Delton U.S. Pat. No. 5,372,927; and
(STGE-29) Zola and Bryant EPO 0 362 699.

The peripheral portion of the tabular grains is then grown onto the edges of the starting tabular grains by the following procedure: A fine grain silver iodide emulsion, preferably a silver iodide Lippmann emulsion, is added to the starting emulsion. Next a soluble silver salt, such as $AgNO_3$, is introduced without further halide salt addition. Since photographic emulsions are precipitated with a stoichiometric excess of halide ion present to avoid grain fogging, there is sufficient bromide ion in the reaction vessel to react with the added silver ion, thereby allowing precipitation onto the edges of the tabular grains. In fact, to obtain bromide ion deposition preferentially at the edges of the tabular grains, the high excess bromide ion concentrations customarily employed in the preparation of silver bromide and iodobromide tabular grain growth are present. For example, it is contemplated to introduce silver ion while maintaining the pBr of the emulsion in the range of from 0.6 to 2.8, which is the range conventionally employed (specifically identified, for example, by Wilgus et al, Kofron et al and Solberg et al, cited above). (Note that, since pBr is the negative log of bromide ion activity, lower pBr numbers indicate higher bromide ion concentrations.) By contrast Piggin et al, cited above, which is depositing onto the major faces of tabular grains, teaches to maintain a pAg that corresponds to a pBr in the range of from 4.3 to 2.8. As silver and bromide ions are being deposited preferentially onto the edges of the starting tabular grains, iodide ions in equilibrium with the fine grain silver iodide are incorporated into the peripherally deposited silver halide, producing a silver iodobromide peripheral region.

The amount of silver and bromide available to form the peripheral region is limited by the necessity of remaining within the favorable pBr range for preferential edge deposition. The amount of iodide introduced can be adjusted to provide any desired iodide concentration within the peripheral region.

From investigations it has been determined that the preferential formation of crystal lattice dislocations in the peripheral regions, contributing to significant speed enhancements, With relatively low levels of dislocations in the central regions are achieved when the iodide concentration in the peripheral region is at least 2 (preferably at least 4) mole percent higher than the iodide content of the central region. Since central region dislocations have been observed to increase as iodide levels are increased, it is preferred to construct the peripheral regions with iodide concentrations at or near the minimal levels for speed enhancement. For example, there is no speed advantage to be realized for increasing the iodide concentration in the peripheral more than 10 mole percent above that in the central region and a typical maximum iodide concentration differential is 8 or less.

Microscopic examination of tabular grains formed according to the teachings of the invention reveal that the peripheral region is quite limited in width, typically being no more than 0.2 μm in width, measured in the plane of a {111} major face and perpendicular to an edge. The peripheral region can extend entirely around the lateral edge of the central portion, but typically contains one or more disruptions. More that 70 percent of the outer peripheral edge of the tabular grains is typically formed by the peripheral region.

By controlling the parameters of preparation as described above and observing photographic performance, response to the localized application of pressure, and both the number and location of dislocations, a novel class of tabular grain emulsions has been created that exhibit a superior combination of photographic speed and constancy of performance as a function of localized pressure application.

The tabular grain emulsions of the invention contain a distribution of dislocations between the central and peripheral regions of the tabular grains that satisfy the relationship: (I)

$$(P+F)\times ECD>5.0$$

where

P represents the percentage of the tabular grains containing at least 10 dislocations in the peripheral regions of the tabular grains, F represents the percentage of the tabular grains containing at least 10 dislocations in the central regions of the tabular grains, and ECD is the average equivalent circular diameter of the tabular grains in micrometers.

The reason for including ECD as a multiplier in relationship (I) is that the grain periphery C [πEECD] corresponding to the peripheral region increases linearly with increasing grain ECD while grain area A [$\pi(ECD+2)^2$] corresponding to the central region increases as the square of ECD. Thus, relationship (I) is derived from the following relationship: (II)

$$P/C+F/A=P/C\times A/F=P/F\times A/C$$

Apart from the features specifically disclosed, the emulsions of the invention can contain any conventional selection of features. For example, the emulsion features of STGE-1 to STGE-28, here incorporated by reference, can be present in the emulsions of the invention. A further summary of conventional photographic emulsion features is provided by *Research Disclosure*, Vol. 365, September 1994, Item 36544. *Research Disclosure* is published by Kenneth Mason Publications, Ltd., Dudley House, 12 North St., Emsworth, Hampshire P010 7DQ, England.

EXAMPLES

The invention can be further appreciated by reference to the following specific examples.

Comparative Example 1

This example demonstrates the preparation of comparative emulsion CE-1.

To a reaction vessel containing 5.5 L of a 0.20 % gelatin aqueous solution containing 0.06 molar NaBr at 60° C., pH 5.8 was added a 0.39 molar $AgNO_3$ solution over a one minute period (consuming 0.21% of the total silver introduced). The contents of the reaction vessel were then ripened in the presence of ammonia for 1.5 minutes at 60° C. After the resultant mixture was neutralized with nitric acid, a solution containing 140 g of gelatin was added to the reaction vessel. An aqueous solution of NaBr (containing 1.5M % KI) and an aqueous $AgNO_3$ solution were added by double jet addition using an accelerated flow with pBr controlled at 1.51 at 60° C. The accelerated flow was such that the final molar flow rate was 11 times that at the beginning, extending over a total of 60 minutes. To this point 70% of total silver was introduced. An aqueous solution of NaBr (3.1 molar) was then added with vigorous stirring until the contents of the reaction vessel were at a pBr of 0.96 at 60° C.

Fine AgI Grains (0.36 mole) were then added to the reaction vessel with stirring. The mixture in the reaction vessel was held for 2 minutes at 60° C. with further stirring. At the end of this 2 minute hold, an aqueous solution of $AgNO_3$ (2.75 molar) was added until a pBr of 2.50 was reached. The addition of $AgNO_3$ was continued (while maintaining the pBr at 2.50 with NaBr) until a total of 12 moles of silver had been used to prepare this emulsion. The emulsion was then cooled and desalted.

The emulsion was an AgIBr tabular grain emulsion having the grain characteristics set out in Table I below.

Example 2

This example demonstrates the preparation of emulsion E-2, satisfying the requirements of the invention.

The preparation procedure of Comparative Example 1 was repeated, except for the following: The amount of fine grain AgI was reduced from 0.36 mole to 0.18 mole.

The emulsion was an AgIBr tabular grain emulsion having the grain characteristics set out in Table I.

Example 3

This example demonstrates the preparation of emulsion E-3, satisfying the requirements of the invention.

The preparation procedure of Example 2 was repeated, except for the following: After the addition of the fine grain AgI and the 2 minute hold, an aqueous solution of $AgNO_3$ (2.75 molar) and an aqueous solution of NaBr (2 molar) were added by double jet addition while controlling the pBr at 0.96, until 1.65 moles of Ag had been added. The pBr was then adjusted to 1.94 before cooling the emulsion to 40° C. and desalting.

The emulsion was an AgIBr tabular grain emulsion having the grain characteristics set out in Table I.

The emulsion was an AgIBr tabular grain emulsion having the grain characteristics set out in Table I.

TABLE I

| Emul. | ECD | t | ECD/t | PA | $I_{cr}$ | $I_{pr}$ |
|---|---|---|---|---|---|---|
| CE-1 | 2.52 | 0.115 | 21.9 | 96 | 1.5 | 10 |
| E-2 | 2.51 | 0.116 | 21.6 | 93 | 1.5 | 5 |
| E-3 | 2.31 | 0.092 | 25.1 | 90 | 1.5 | 5 |

Emul. Emulsion
ECD Average ECD in micrometers (μm)
t Average tabular grain thickness in μm
PA % of total grain projected area accounted for by tabular grains
$I_{cr}$ mole % I added during growth of central region of grains
$I_{pr}$ mole % I added during growth of peripheral region of grains Example 5

Tabular grain samples of the emulsions of the above examples were then microscopically examined for dislocations.

From this examination the dislocation characteristics reported in Table II were observed.

TABLE II

| Emul. | P | F | P/F | (P/F)ECD |
|---|---|---|---|---|
| CE-1 | 96 | 57 | 1.7 | 4.28 |
| E-2 | 93 | 20 | 4.7 | 11.80 |
| E-3 | 57 | 9 | 6.3 | 14.55 |

P percent of tabular grains containing at least 10 dislocations in their peripheral region
F percent of tabular grains containing at least 10 dislocations in their central region Example 6

Samples of the emulsions described above were then sensitized and evaluated for photographic sensitivity and pressure sensitivity.

Samples of the emulsions were each optimally chemically sensitized with sulfur and gold sensitizers and each spectrally sensitized with the same combination of the of the following dyes:

Dye 1

Anhydro-5,5'-dichloro-9-ethyl-3,3'-bis(3-sulfopropyl) thiacarbocyanine hydroxide, triethylammonium salt Dye 2

Anhydro-9-ethyl-5,5'-dimethyl-3,3'-bis(3-sulfopropyl) thiacarbocyanine hydroxide, triethylammonium salt The sensitized emulsions were combined with a cyan dye-forming coupler and coated on a photographic film support at a silver coating coverage of 10.76 $mg/dm^2$.

Exposure was undertaken through a step wedge for 1/100 second at a color temperature of 5500° K. Exposed film samples were developed for 2 minutes and 15 seconds using Kodak Flexicolor C-41™ color negative processing.

At least one portion of each film sample was exposed and processed without the local application of pressure. Prior to exposure pressure was applied to at least one remaining portion of each film sample with a roller mechanism capable of creating a uniform localized pressure. The reduction in density formed in portions to which pressure was applied as compared to corresponding portions to which pressure was not applied is referred to as pressure desensitization. The "Pressure Metric" of Table III below was calculated by summing the density difference between the corresponding portions for each level of exposure (a negative value for pressure desensitization). This number was then normalized for developability variation due the level of exposure by dividing the sum by the difference between maximum and minimum density of the sample portion to which pressure was not applied and then multiplying by −1000 (so that the pressure metric number was a positive whole number). The lower the pressure metric, the lower the level of pressure desensitization.

The speed reported is that of the sample portion that did not receive pressure. Speed is reported in relative log speed units. Each unit difference in relative speed represents 0.01 log E, where E represents speed in lux-seconds. Speed was measured at a toe density $D_s$, where $D_s$ minus $D_{min}$ equals 20 percent of the slope of a line drawn between $D_s$ and a point D' on the characteristic curve offset from $D_s$ by 0.6 log E.

The results are summarized in Table III.

TABLE III

| Emul. | Speed | Pressure Metric | (P/F)ECD |
|---|---|---|---|
| EC-1 | 100 | 85 | 4.28 |
| E-2 | 95 | 46 | 11.80 |
| E-3 | 100 | 32 | 14.55 |

From Table III it is apparent that pressure desensitization can be minimized by placing the dislocations in the major faces of the tabular grains so that (P/F)ECD remains above 5.0. This requires that the percentage of tabular grains having 10 or more dislocations in the peripheral regions of the grains be high in comparison to dislocations in the central regions of the grains. As is apparent from Table III, merely optimizing an emulsion for photographic speed does not in itself lead to the selection of a tabular grain structure that remains relatively constant as a function of applied pressure.

The invention has been described in detail with particular reference to preferred embodiments thereof, but it will be understood that variations and modifications can be effected within the spirit and scope of the invention.

What is claimed is:

1. A radiation-sensitive emulsion in which greater than 50 percent of total grain projected area is accounted for by tabular grains (i) containing greater than 50 mole percent bromide, based on silver, (ii) having parallel {111} major faces bounded by peripheral edge surfaces and (iii) containing 10 or more dislocations,

WHEREIN the tabular grains exhibit an average equivalent circular diameter of at least 2.0 μm, an average thickness of less than 0.3 μm, and an average aspect ratio of greater than 8 and are each comprised of a central region formed by starting tabular grains and a peripheral region grown onto edges of the starting tabular grains forming the central region, each of a face centered cubic rock salt crystal lattice structure and extending between the major faces, the peripheral region separating at least a portion of the central region from the peripheral edge surfaces by up to 0.2 μm and containing an iodide concentration at least 2 mole percent, based on silver, higher than the iodide concentration of the central region measured within 50 nm of the peripheral region, and the dislocations in the central regions are relatively decreased in relation to the dislocations in the peripheral regions to satisfy collectively the relationship $$(P+F)\times ECD>5.0$$

where

P represents the percentage of the tabular grains containing at least 10 dislocations in the peripheral regions of the tabular grains, F represents the percentage of the tabular grains containing at least 10 dislocations in the central regions of the tabular grains, and ECD is the average equivalent circular diameter of the tabular grains in micrometers.

2. A radiation-sensitive emulsion according to claim 1 wherein the tabular grains exhibit an average thickness of less than 0.2 μm.

3. A radiation-sensitive emulsion according to claim 2 wherein the tabular grains exhibit an average thickness of less than 0.1 μm.

4. A radiation-sensitive emulsion according to claim 1 wherein the tabular grains are silver iodobromide grains.

5. A radiation-sensitive emulsion according to claim 1 wherein the tabular grains account for at least 70 percent of total grain projected area.

6. A radiation-sensitive emulsion according to claim 1 wherein the peripheral region contains an iodide concentration that is at least 4 mole percent higher than that of the central region.

7. A radiation-sensitive emulsion according to claim 1 wherein the peripheral regions form more than 70 percent of the peripheral edges of the tabular grains.

* * * * *